US005893996A

United States Patent [19]

Gross et al.

[11] Patent Number: 5,893,996

[45] Date of Patent: Apr. 13, 1999

[54] ELECTRIC RADIANT HEATER WITH AN ACTIVE SENSOR FOR COOKING VESSEL DETECTION

[75] Inventors: Martin Gross, Kämpfelbach/Ersingen; Nils Platt, Leonbronn, both of Germany

[73] Assignee: E.G.O. Elektro-Gerätebau GmbH, Germany

[21] Appl. No.: 08/792,383

[22] Filed: Feb. 3, 1997

[30] Foreign Application Priority Data

Feb. 5, 1996 [DE] Germany ..... 196 03 845

[51] Int. Cl.[6] ..... H05B 3/68; H05B 1/02; H05B 6/12

[52] U.S. Cl. ..... 219/452; 219/464; 219/518; 219/621

[58] Field of Search ..... 219/451, 452, 219/464, 466, 518, 621, 626, 665

[56] References Cited

U.S. PATENT DOCUMENTS

| | | | |
|---|---|---|---|
| 3,796,850 | 3/1974 | Moreland, III et al. | 219/626 |
| 4,013,859 | 3/1977 | Peters, Jr. . | |
| 4,319,109 | 3/1982 | Bowles | 219/626 |
| 4,334,135 | 6/1982 | Smith | 219/626 |
| 4,347,432 | 8/1982 | Gossler | 219/466 |
| 4,393,299 | 7/1983 | McWilliams | 219/466 |
| 5,136,277 | 8/1992 | Civanelli et al. | 219/452 |
| 5,223,697 | 6/1993 | Wilde et al. | 219/518 |
| 5,296,684 | 3/1994 | Essig et al. | 219/518 |
| 5,424,512 | 6/1995 | Turetta et al. | 219/518 |

FOREIGN PATENT DOCUMENTS

| | | |
|---|---|---|
| 442 275 | 8/1991 | European Pat. Off. . |
| 0 469 189 A2 | 2/1992 | European Pat. Off. . |
| 490 289 | 4/1995 | European Pat. Off. . |
| 37 11 589 | 10/1988 | Germany . |
| 37 33 108 | 2/1989 | Germany . |
| 37 33 108 C1 | 2/1989 | Germany . |
| 40 39 501 | 6/1992 | Germany . |
| 42 35 085 A1 | 4/1993 | Germany . |
| 41 42 872 | 6/1993 | Germany . |
| 42 24 934 A1 | 2/1994 | Germany . |

*Primary Examiner*—Teresa Walberg
*Assistant Examiner*—Sam Paik
*Attorney, Agent, or Firm*—Quarles & Brady

[57] ABSTRACT

An electric radiant heater is constructed with a pot detection system for switching on one or more heating areas. The pot detection system operates inductively according to the resonant circuit detuning principle. The sensor consists of a single-turn loop made from thick wire and which in the vicinity of the heating areas is positioned above the latter and just below a glass ceramic plate. In the case of a two-circuit heater, the sensor loop is shaped with clearly defined circumferential areas in said heating areas, so that the signal has a stepped transition between these areas and consequently a pot size detection in adaptation to the heating areas is possible.

19 Claims, 5 Drawing Sheets

ELECTRIC RADIANT HEATER WITH AN ACTIVE SENSOR FOR COOKING VESSEL DETECTION

TECHNICAL FIELD

The invention relates to an electric radiant heater with an active sensor for detecting the positioning of a cooking vessel on a hotplate covering the heater and in particular a glass ceramic plate.

DESCRIPTION OF THE BACKGROUND ART

The automatic switching on and off of a hotplate as a direct function of the placing thereon of a cooking vessel has been a long existing aim, but which has hitherto only been achieved incompletely, with great technical cost and not having the necessary reliability, so that such systems have found relatively little practical application.

The systems proposed for this purpose are based on the most varied principles, the nature and arrangement of the sensor usually being decisive. Thus, mechanical, capacitive, optical, resistive and inductive sensors have been proposed. In inductive sensors both coils with several turns and also those with a single turn have been proposed. These coils are either circular and arranged concentrically to the cooking zone or frame the latter in the case of non-circular cooking zones. These coils are normally located in the vicinity of the marginal insulation (cf. EP 490 289 B1 and EP 442 275 A2).

The aforementioned, single-turn pot detection loop is known from DE 37 11 589 A1. It is a passive short-circuit loop positioned between the heating elements and a glass ceramic plate. It is extraneously supplied by a magnetic field generator located below the heating elements. By periodic short-circuiting and a corresponding damping measurement, the evaluating circuit is energized. The introduction of such a system into practical application has failed due to the considerable cost and in particular the necessarily large overall height for the housing of the magnetic field generator.

The aforementioned multi-turn coils in the outer marginal area (or in an unheated central area) give rise to thermal problems and, as has been recognized by the invention and as will be explained hereinafter, are less suitable for sharp signal generation and detection.

SUMMARY OF THE INVENTION

The problem of the invention is to provide a radiant heater having an active sensor, in which in the case of a simple and robust sensor construction, there is a very precise signal for controlling the heater.

This problem is solved by claim 1.

The sensor, which is part of an inductively operating resonant circuit of a control, preferably using resonant circuit detuning, is in the form of a loop of electrically conductive material passing round in the vicinity of the heating area and at least partly covering the latter. Thus, unlike in the case of a sensor passing round the marginal area of the heater, the signal is much more informative with respect to the coverage of the heating area and therefore more precise for detection purposes. This is unusual in that it would be assumed that through a sensor located on the edge or rim the associated cooking vessel size would be particularly accurately detected, because the signal magnitude in the form of the relative frequency shift in the marginal area is particularly great and then drops strongly in parabolic manner towards the centre. However, the problem here is that, as has been established, such a marginal coil can scarcely distinguish between a relatively small pot, which is to bring about switching on, and a large pot displaced towards the heating surface and which is not intended to cause a switch on. Moreover, with marginal coils the problem always existed that radiant heaters normally are located in a sheet metal plate or tray, whose bottom and in particular edge greatly damps the resonant circuit. Therefore the field extends over a very narrow marginal area, which supplies an evaluatable signal.

With such radiant heaters account must be taken of the fact that the bottom of the sheet metal plate brings about a damping of the magnetic field, so that the latter can only be formed in relatively small area manner as a tube around the sensor conductor.

Through the placing of the sensor loop in the vicinity of the heating area it is possible to obtain a very large coverage of the sensor in the region in which the pot is to bring about a switch on and a minimum coverage in the region in which the particular heating element is to be switched off.

Thus, when correctly centrally positioned, even a small pot leads to a large signal, whereas a displaced pot supplies a small signal clearly differentiable therefrom. Thus, the sensor loop should have its effective diameter in the minimum diameter range and advantageously somewhat beyond this, namely around the range of the magnetic field "tube". Due to the distance from the outer rim there is no significant damping by the same and which would so-to-speak simulate a pot. Therefore it is possible to only have a sensor loop with one or a few turns, whereas previously it was considered necessary to have a coil with several turns in order to obtain an adequately large signal in the form of a frequency shift in the measuring resonant circuit.

Thus, advantageously, the invention makes it possible to place the sensor loop in the immediate vicinity of the heating area, i.e. directly exposed to the radiant heat, because with such a coil with one or only a few turns and with an air separation between them, there is no need for an insulation. It can consist of a design-fixed, self-supporting and heat-resistant conducting material, preferably a solid, strong wire.

The material can be high-alloyed steel, e.g. a FeCrNi alloy. The construction from non-ferromagnetic material is appropriate, because with a ferromagnetic material due to the high temperature which occurs the Curie point can be exceeded and the magnetic characteristics changing at this point would lead to a signal, which would be completely independent of the desired determination of the cooking vessel position and would therefore falsify the result.

The sensor loop and control can be advantageously constructed for cooking vessel size detection. To this end the sensor loop can have radially spaced, differing action areas, e.g. in different circumferential areas substantially circumferentially loop portions, which are interconnected by radial connecting portions. This can e.g. lead to a sensor loop with a circular or polygonal shape with omega-shaped bulges. This clover leaf shape has proved to be particularly advantageous.

As the signal magnitude largely corresponds to the degree of coverage of the sensor loop by a cooking vessel, the "frequency deviation/diametral coverage by the cooking vessel" characteristic as opposed to the parabolic course has a stepped configuration with a steep portion displaced more towards the interior of the heating area and in the case of two-circuit heaters can have two diameter steps. In this way the signal curve or course can be more adapted to the ideal shape. This would be with a heater having only one heating area a flat or shallow signal course in the marginal area, a very steep drop in the vicinity of the diameter of a minimum sized pot, which still brings about a switch on and then a flat, very deep path towards the centre of the heating area.

With a two-circuit heater in which, as a function of the cooking utensil size, either only one (central) or both heating zones are to be switched on, by a sensor having two action areas a very precise signal curve with two approximate steps can be obtained, which can bring about a differentiated switching on of the two heating zones.

It is easy to position the robust, self-supporting sensor loop with random heater configurations. The latter generally have an outer, insulating material rim and with two-circuit heaters optionally a partition. On the latter can rest the sensor loop and for this purpose recesses are located therein, so as to bring about an engagement of the sensor and insulating rim on the plate or a limited spacing therefrom. Also with the existing heater designs a subsequent equipping with a pot detection means is possible.

It has been that as a result of the shape, nature and arrangement of the sensor loop, it is possible to significantly improve very poor signal-to-noise ratios occurring with the hitherto known sensors.

These and further features can be gathered from the claims, description and drawings and the individual features, both singly and in the form of sub-combinations, can be implemented in an embodiment of the invention and in other fields and can represent advantageous, independently protectable constructions for which protection is hereby claimed. The subdivision of the application into individual sections and the intermediate signals in no way limit the general validity of the statements made thereunder.

BRIEF DESCRIPTION OF THE DRAWINGS

An embodiment of the invention is described hereinafter relative to the drawings, wherein show.

DETAILED DESCRIPTION OF THE PREFERRED EMBODIMENT

Figure 1:
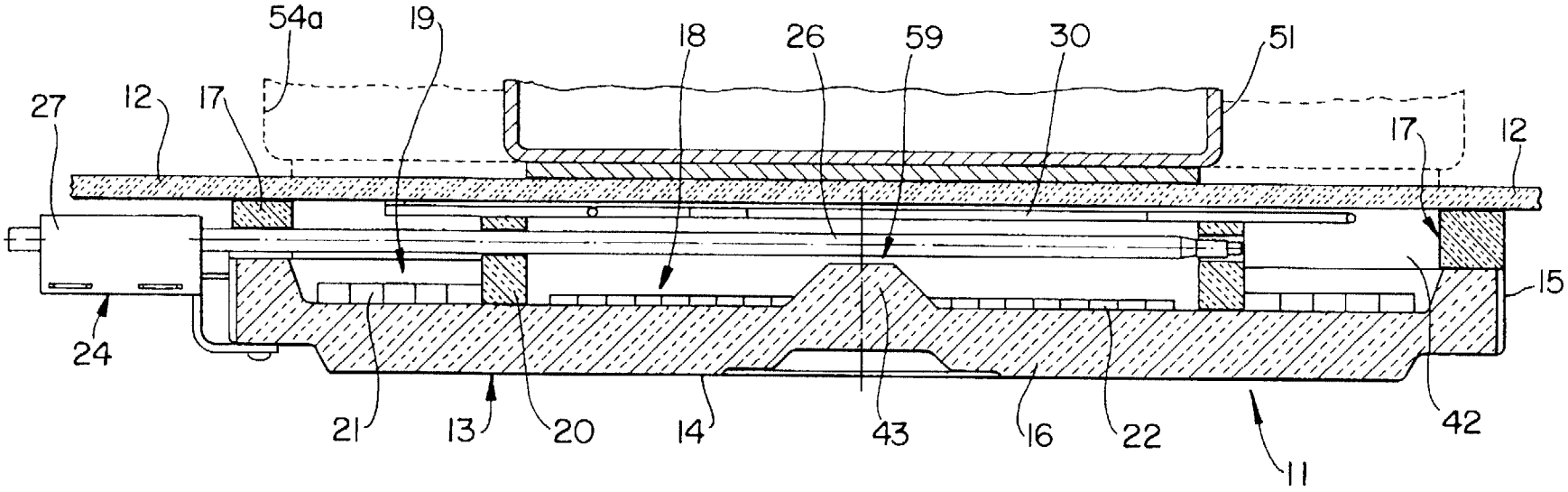
FIG. 1 A central section through a radiant heater under a glass ceramic plate with intimated cooking vessels.
Figure 2:
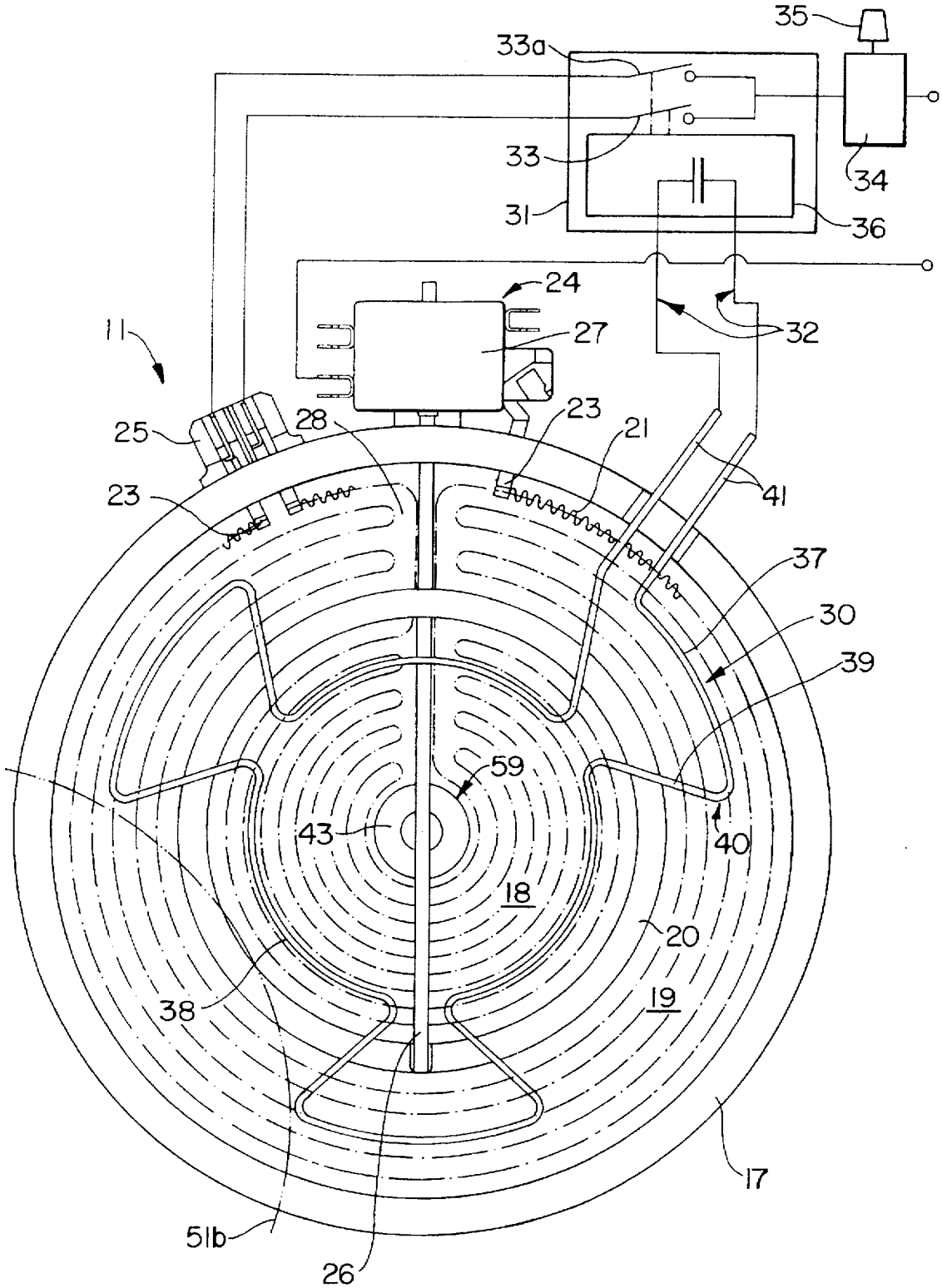
FIG. 2 A plan view of the radiant heater of FIG. 1.

FIGS. 1 and 2 show an electric radiant heater 11, which is positioned below a glass ceramic plate 12 of an electric hob or some other radiant cooking utensil. It has a flat sheet metal plate 13, whose bottom 14 and rim 15 receive a bottom layer 16 and a rim 17 of electrically and thermally insulating, damping, heat-resistant insulating material. It is preferably in the form of microporous fumed silica aerogel pressed from bulk material. The outer rim 17 is separately manufactured for improved mechanical strength reasons and comprises a pressed or wet-shaped and then subsequently dried fibrous material with binders, etc.

The sheet metal rim 15 does not extend completely up to the glass ceramic plate 12 in the manner of the insulating rim 17 which is pressed onto the said plate from below, in that the heater 11 is pressed upwards by a not shown pressure spring.

The radiant heater has two mutually concentric heating zones or areas 18, 19, which are demarcated from one another by a partition 20, but which does not extend up to the glass ceramic plate.

In both heating areas 18, 19 are provided in standing manner electric heating elements 21 in the form of thin, corrugated strips, which are upright on the surface 22 of the insulator 16 and are anchored therein with feet shaped onto the underside thereof and which have a spade shape due to the corrugation of the strip. They uniformly cover the two heating areas 18, 19 with the exception of an unheated central area 59, in which is located an upwardly directed projection 43 of the insulating bottom 16.

FIG. 2 shows the arrangement of the heating elements in meander-like circular paths and are so switched by means of heating element terminals 23 to a thermostat 24 and a separate connecting member 25, that the outer heating area 19 during the operation of the heater can be connected in, as desired, to the constantly switched on heating area 18. The thermostat 24 has a rod-like sensor 26, which acts on a thermostat contact for maintaining a permitted maximum temperature on the glass ceramic underside and on a hot indicating contact for signalling the hot state of the heater in a thermostat head 27. The sensor 26 projects through the insulator rim 17 and the partition 20 and passes in a plane above the heating elements 21, but largely in a passageway 28 free from heating elements.

The heater has a sensor in the from of a loop 30, which is part of a control 31 for detecting the position of a cooking vessel on the hotplate 12 covering the heater. The sensor loop 30 forms an inductance of a resonant circuit 32, which is excited with a relatively high frequency of e.g. 1 to 5 MHz. On placing a cooking vessel thereon, there is a change to the damping of the sensor loop 30 and therefore the frequency of the resonant circuit 32. It is evaluated in the control 31 and as a function thereof mechanical or electronic switches 33, **33*a* in the control are activated and switch on the heating areas 18, 19**.

For setting the released power there is also a power controller 34, which can be set to a given power level by means of a control knob 35. It is also possible to provide a temperature regulator. With regards to the regulator or control it is generally a timed power release, i.e. an interrupted regulator or control. The power controller 34 can be constructed thermomechanically, i.e. as a bimetallic switch or, preferably, as an electronic component, which can optionally be integrated into the control 31. In order to keep interfering influences away from the resonant circuit 32, the line between the sensor loop 30 and the remaining elements of the resonant circuit should be kept as small as possible. It is also possible to shield the lines. Optionally the control component 36 containing the cooking vessel detection means could be positioned close to the radiant heater 11 separately from the remaining heater control.

The sensor loop 30 comprises a relatively thick round wire with a diameter between 1 and 4 millimeters, preferably approximately 2 mm and is made from a heat-resistant, non-magnetizable material. It can e.g. be a high-alloyed steel such as an iron-chromium-nickel alloy. Suitable materials are e.g. steel with material No. 1.4876 or a heating conductor material No. 2.4869.

The sensor can be earthed or grounded on one side. To obtain a limited ground resistance (preferably below 0.1 ohm) and the consequently necessary very low ohmic resistance of the sensor, the latter can be made correspondingly thick. For its function as a pot detection sensor with high frequency energization, due to the skin effect only its surface is effective, so that it could also be constructed as a tube. Due to the limited ohmic resistance, it could then be filled with copper or some other highly conductive material, whereas the jacket material ensures the temperature resistance and scale resistance. It is particularly advantageous to have a construction with a highly conductive electrodeposit, e.g. of silver, or a construction of good conducting solid material with e.g. a non-scaling electrodeposit. The very stiff construction of the sensor loop 30 ensures that even in the case of high thermal stresses a sinking onto the heating elements 21 is unlikely.

Reference should be made to the drawings concerning the shape of the sensor loop 30. In FIG. 2 the sensor loop forms a single-turn coil with outer circumferential portions 37 passing over the outer heating area 19 but with a relatively large radial distance from the outer rim 17 and, once again with a radial spacing from the partition 20, inner circumferential portions 38 passing over the heating area 18.

These circumferential portions are in FIG. 2 arcuate portions of different diameter interconnected by connecting portions 39. Although these connecting portions run substantially radially, they are inclined in such a way that the angle sum of the outer and inner circumferential portions 37, 38 exceeds 360°. A plan view of the sensor loop 30 has the basic shape of a three-leaf clover with a relatively large central area almost forming a complete circle and three lateral "leaves" in the form of a triangular sector or omega. As a function of the size and control requirements, more circumferential portion sectors can be provided. On one of the circumferential portion sectors 40 are provided connections or terminals 41 in the form of outwardly directed, parallel loop material portions.

The complete sensor loop 30 with the described shape is flat and due to the relatively thick material is self-supporting and dimensionally stable. In the present embodiment on one side in the vicinity of the terminals 41 it is located in shallow depressions of the insulator outer rim 17 and is otherwise supported by its connecting portions 39 on the partition 20, which does not extend up to the glass ceramic plate. Thus, the sensor loop engages or is at a limited distance from the underside of the glass ceramic plate 12 and is positioned with a clearance above the heating elements 21. It can be seen that the sensor 26 of the thermostat only passes beneath the sensor loop once due to the represented arrangement and this is in the vicinity of an inner circumferential portion 38. In this zone it also passes in the passageway 28, so that it could be positioned somewhat lower without any risk of colliding with the heating elements 21. It is also possible to in each case pass out one of the terminals 41 on one side of the temperature sensor 26, so that no sensor-loop crossing occurs. The sensor and loop can then be located in the same plane. This would also ideally utilize the space 42, defining the overall height of the radiant heater, between the bottom 16 carrying the heating elements 21 and the glass ceramic plate 12 and the spacings can be maintained for high voltage testing.

Figure 4:
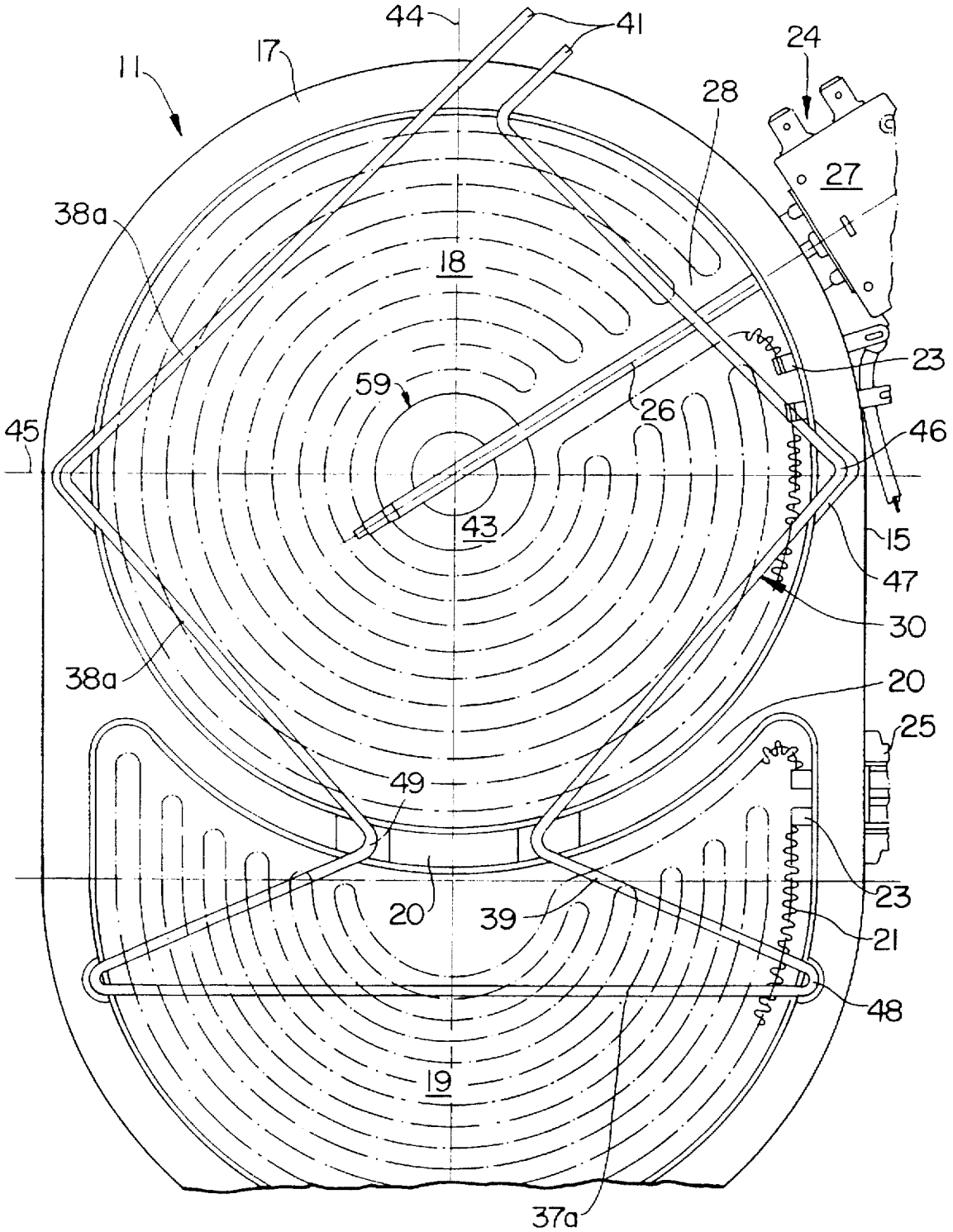
FIG. 4 A plan view of a radiant heater variant.

Whereas FIG. 2 shows a two-circuit heater with two concentric heating areas 18, 19, FIG. 4 shows a two-circuit heater with an elongated, oval shape. With otherwise the same basic construction, this radiant heater 11 has a circular main heating area 18, to which is connected on one side, demarcated by a partition 20, an additional heating area 19, which has a half or quarter moon shape. A thermostat 24 is provided in inclined manner on the main heating area 18 and its sensor 26 projects radially only roughly up to its centre, where it rests on a central projection 43 in the unheated central area 59 of the insulator bottom 16.

The sensor loop 30 provided for this radiant heater is made from the same material as that according to FIGS. 1 and 2. It is shaped like a rectangle comprising linear circumferential portions and which in the vicinity of the median longitudinal plane 44 of the heater form parallel, outwardly passed terminals 41. The corners or angles 46 of the rectangle in the vicinity of the transverse longitudinal plane 45 of the main heating area 18 are located in corresponding shallow depressions 47 of the insulator outer rim 17, but within the sheet metal tray rim 15. Thus, the circumferential portions 38 pass in the form of chords with a clear spacing from the outer rim over large surface portions of the heater and consequently have an effective diameter in the vicinity of the heating area 18.

In the vicinity of the intersection of the median longitudinal plane 44 and the partition 20, i.e. on the angle of the rectangle facing the terminals, is connected with a pronounced outward bend in each case one connecting portion 39 extending up to the outer corners 48 which, like the corners 46, rest in corresponding depressions on the insulator outer rim 17. They are interconnected by a linear portion **37*a* in this embodiment, which substantially centrally traverses the additional heating area 19 and passes transversely to the median longitudinal plane 44. This portion could also be rounded corresponding to the half moon shape of the additional heating area 19. Thus, the sensor loop 30 rests at seven points on the insulator, namely at the corners 46 and 48, the terminals 41 and with the inner corners 49 between the rectangle legs 38*a* and the connecting portions 39 on the partition 20**. The basic shape is roughly the same as a stylized fish.

Figure 7:
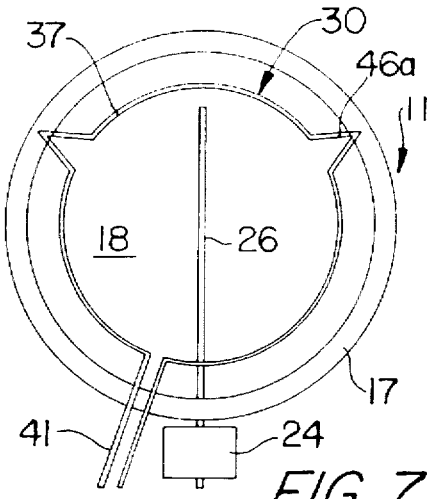
Figure 8:
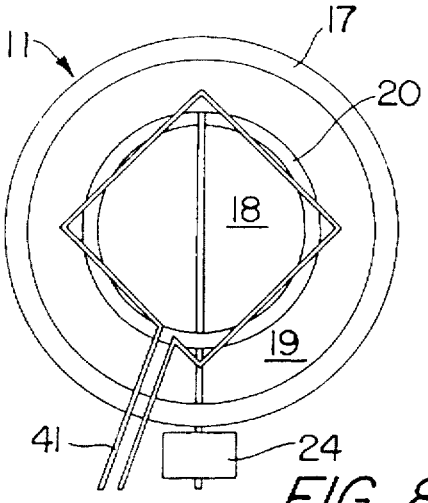
Figure 9:
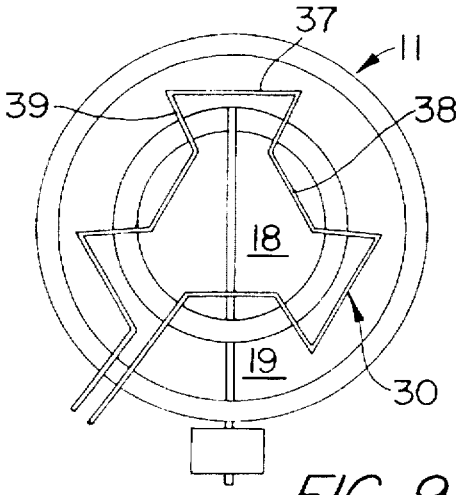

Of the sensor loop shapes diagrammatically shown in FIGS. 5 to 10, that of FIG. 9 roughly corresponds to the shape of FIG. 2, but with straight circumferential portions 37, 38 in place of the arcuate configuration of FIG. 2. The circumferential portions 39 are once again substantially radially directed and are not as retrogressive as in FIG. 2. Due to the divergence from the theoretical ideal shape of the circle (or pot shape), this embodiment has a reduced accentuation of the signal steps compared with FIG. 2, but is easier to manufacture.

Figure 5:
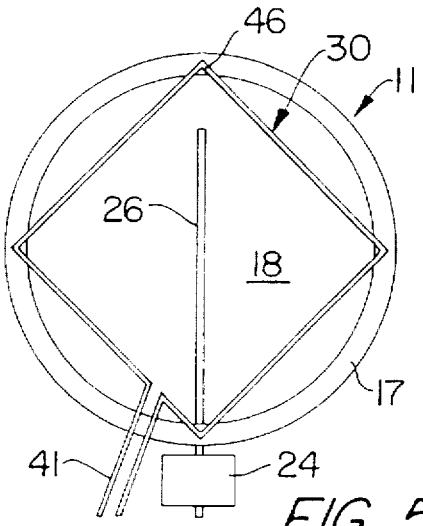
FIGS. 5–10 Plan views of further variants in diagrammatic form.
Figure 6:
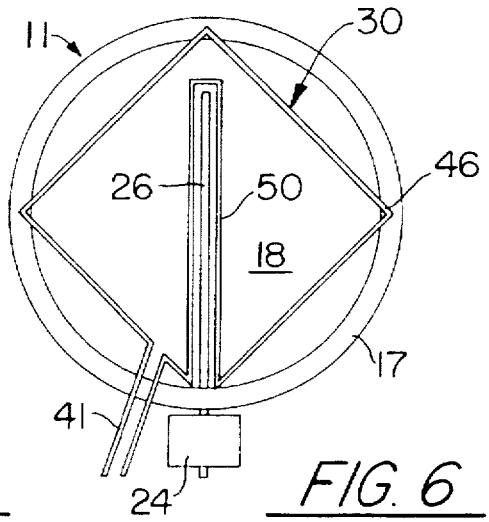

The constructions according to FIGS. 5 to 7 are intended for single-circuit heaters, i.e. heaters having only one cohesive and always jointly operated heating area 18. The sensor loop 30 of FIG. 5 is in the form of a square with corners or angles 46 supported on the rim 17. The sensor 46 of the thermostat 24 projects substantially diagonally over the field demarcated from the sensor.

FIG. 6 shows a construction corresponding to FIG. 5, but in which the sensor 26 of the thermostat 24 is flanked on both sides by straight portions of the sensor loop 30. Behind the free end of the temperature sensor 26 they are interconnected. This makes it possible to have the temperature sensor and sensor loop in the same plane, which helps to reduce the overall height, whilst giving adequate electrical spacings.

FIG. 7 shows a particularly preferred construction of the sensor loop 30, which, spaced from the rim 17, has circumferential portions 37 almost forming a complete circle and which are only interrupted by the parallel, led out terminals 41 and cat ear-shaped, outwardly directed corners **46*a*, which ensure the necessary bearing on the outer rim 17**.

FIG. 8 shows a sensor loop 30 for a two-circuit heater, which is located in the area of the partition 20 between the main heating area 18 and the additional heating area 19 surrounding it. The substantially square construction much as in FIG. 5 of the loop is significantly smaller and extends with the outer corners into the vicinity of the additional heating area, whereas the circumferential portions 38 pass over the outer main heating area 18.

Figure 10:
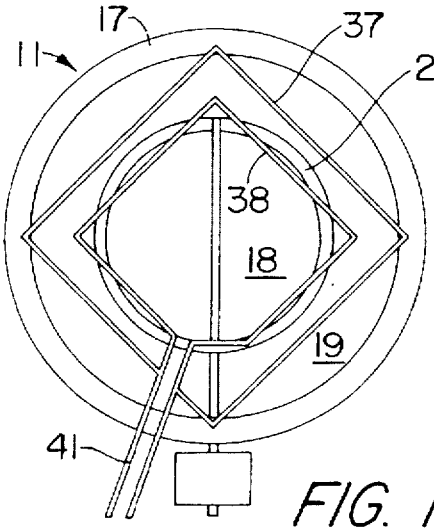

FIG. 10 shows a construction for a two-circuit heater which, unlike the other heaters which essentially comprise a single-turn loop, forms a double, parallel-connected loop. It is in the form of two squares located within one another and both of which are connected to the same terminals 41 and merely for increasing their surface coverage have spaced circumferential portions, but which electrically form in each case a single-turn loop. The inner loop, as shown in FIG. 8, rests on the partition 20, whereas the outer loop, according to FIG. 5, rests with its corners on the outer rim 80. The relatively design-fixed, but elastic construction of the sensor loop also makes it possible to reliably fix it in recesses in the rim, e.g. by snapping in. It is also possible to bring about fixing by sticking into the insulating material, e.g. using welded pins.

The method according to which the pot detection system operates will now be described relative to FIGS. 1 to 3.

If the radiant heater 11 is to be put into operation, the desired power stage is set on the control knob 35 and consequently the control 31 and cooking vessel detection means 36 can be put into operation. This vessel detection system operates inductively, i.e. the resonant circuit 32 is excited with a relatively high frequency between 1 and 5 MHz and the pot detection system whose result is described hereinafter is constructed in per se known manner. For details reference should be made to European patent application 442 275 A2.

Around the wire of the sensor loop 30 is produced an alternating electromagnetic field, whose characteristics help to determine the resonant circuit frequency.

If a cooking vessel 51 is now placed on the plate 12, said magnetic field is changed, i.e. the sensor loop is damped, so that the frequency of the resonant circuit 32 changes. This frequency change is evaluated in the pot detection component 36 and, on reaching the preset threshold, leads to the switching on of one or both switches 33, 33*a*, so that current now flows through the heating elements 21 and heating takes place.

Figure 3:
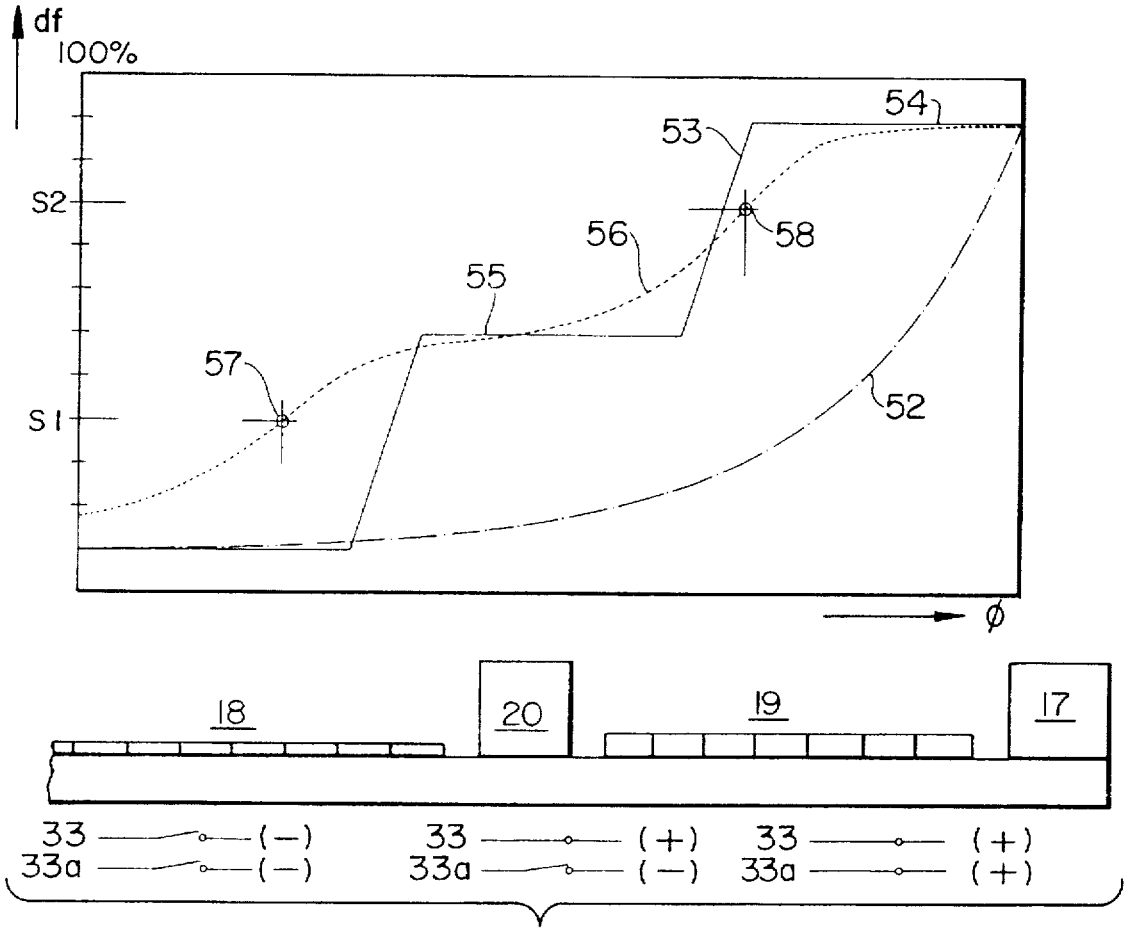
FIG. 3 A diagram concerning the frequency response with a two-circuit heater.

The diagram of FIG. 3 shows the relative frequency response df over the diameter, i.e. the frequency change df as a percentage of the maximum frequency change during the measurement as a function of the diameter coverage of the hot-plate and therefore the sensor loop by a cooking vessel. FIG. 1 is intimated below the diagram to show the cross-section of the heater 11.

The diagram shows that when using a conventional sensor coil located in the rim 17, there would be the frequency change configuration over the diameter illustrated by the dot-dash line 52. The signal value summated over the circumference would be proportional to the coverage of the circumferential line. A precisely centrally set down large pot 51*a* (cf. FIG. 1) would consequently give rise to a good signal, but a somewhat smaller pot, despite a precise central coverage, would not lead to a usable signal. If the switching threshold would e.g. be placed well below 50% of the total signal magnitude, on the one hand the signal noise, which is relatively large with such sensors and their arrangement, would render a circuit unreliable and on the other an eccentrically displaced pot (cf. the double dot-dash line 51*b* in FIG. 2) would lead to an undesired switching on.

The ideal curve shown in continuous line form in FIG. 3 has two steps, namely the upper step 54, which corresponds to the large pot 51*a* covering both heating areas 18, 19 and which should bring about the switching on of both areas 18, 19 and a lower step 55, e.g. at 50% of the frequency difference df. In the vicinity of said step corresponding to the diameter of the smaller pot 51, the central main heating area 18 only should be switched on, whereas at the left-hand end of the step 55 giving the minimum pot diameter for the central heating area, the signal should rapidly drop.

It can be seen that the curve 56 produced by the sensor loop 30 approaches the theoretical ideal curve 53, in that although generally having a substantially linear course, i.e. the signal magnitude is largely proportional to the covered diameter, it contains steps approaching the step shape of the ideal curve. This makes it possible with only one sensor to reliably distinguish between large and small pots and in particular make a distinction between a displaced pot, which should bring about a switching on, and a small pot which is intended to start up the central main heating area.

FIG. 3 shows the switching point 57, 58. At point 57 (signal level S1) the central heating area 18 is to be switched on and remain so up to the switching point 58 (switch 33 "on"). At switching point 58 (signal level S2) the outer heating area 19 is then connected in (both switches 33 and 33*a* "on"). In other words the switching point 58 symbolizes the smallest size of the large pot 51*a* to operate with both heating areas, whereas the switching point 57 indicates the smallest size of a pot 51 which can lead to a switching on.

It can in particular be seen that in the vicinity of the switching points 57, 58 the gradient of the signal curve 56 is relatively great, so that a reliable switching can take place, even when taking account of interference factors. It can also be seen that this would not be possible with curve 52 of a conventional sensor coil.

The following takes place with respect to the sensor coil. In the case of the cooking vessel 51 shown in FIG. 1, it is a pot whose diameter corresponds to that of the central main heating area 18. It covers the zone of the heating area 18 and the corresponding zone of the sensor loop 30, i.e. mainly the inner circumferential portions 38. This leads to a signal level which is roughly in the vicinity of the first step 55 in FIG. 3. Thus, this signal is between the signal values S1 and S2, so that only the central, main heating area 18 is switched on.

On setting down the larger pot 51*a*, in addition to the inner circumferential portions 38, also the outer circumferential portions and the connecting portions 39 would be covered, so that there would be a more pronounced signal change. The step nature revealed in FIG. 3 results from the position of the circumferential portions 37, 38, which in the case of coverage give a relatively sharp signal change, whereas between them are located the relatively shallow curve portions corresponding to steps 54 and 55 of the ideal curve.

Cooking takes place without any influencing by the pot detection system controlled either by the power or temperature and accompanied by the monitoring of the thermostat 24, which protects the glass ceramic plate from overheating.

In the embodiment of FIG. 4 the function is comparable, except that in place of the concentric arrangement the juxtaposing of the heating areas and their coverage by a corresponding round or elongated cooking utensil (oval roasting utensil) leads to the switching on of only the main heating area 18 or in addition the additional heating area 19. Here again there is a certain step nature due to the arrangement of the individual portions of the sensor loop. As a result of the stepped signal course the possibility exists of switching in a diameter-dependent manner.

Figure 11:
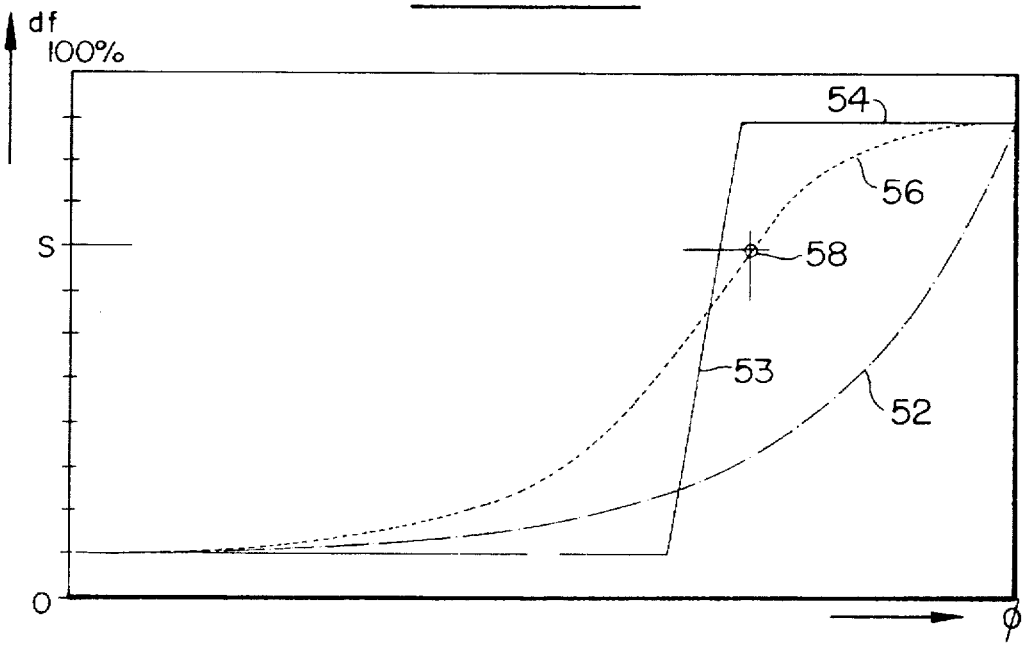
FIG. 11 A frequency response diagram of a sensor for a single-circuit heater (FIGS. 5 to 7).

In the case of a single-circuit heater shown in FIGS. 5 to 7 and having a single heating area 18 the signal course is as in FIG. 11. The ideal curve then only has one step 54 and there again the signal curve 56 of the sensor coil 30 according to the invention is largely adapted to said ideal curve, so that at the switching point 58 (smallest possible pot) there is a steep signal curve for switching on and off. In the case of the curve 52 of a conventional sensor coil, the switching point would be in an area of such small signal magnitudes that no reliable switching would be possible.

Thus, the invention provides a radiant heater with a pot detection sensor, which is not only particularly simple, robust and reequippable, but which also supplies a precise signal usable for switching in a wide range. This in particular leads to several action or operating areas for the pot detection, so that pots of differential diameter initiate different heatings. With one sensor a true cooking vessel size detection is possible. It would also be possible, admittedly with greater constructional expenditure, to achieve this e.g. with two-circuit heaters by using two sensors according to the invention, which compared with an arrangement of two conventional sensors in the outer and intermediate rim would lead to both constructional and in particular functional advantages.

As a result of the positioning in the vicinity of the heating area, a result is obtained over the diameter with changes usable for switching purposes and which in a rough approximation could be referred to as linearized, but which advantageously has the step function response shown in FIGS. 3 and 11.

We claim:

1. Electric radiant heater comprising at least one heating area heated by electric radiant heating elements; and an active sensor for detecting the positioning of a cooking vessel on a hotplate covering the heater, the sensor being part of an inductively operating resonant circuit of a control means responsive to frequency changes caused by presence of the cooking vessel, said sensor being a loop of electrically conductive material positioned mainly over the heating area, at least partly extending over the radiant heating elements and being spaced therefrom by an air gap, the sensor loop and the control means being provided for detecting different sizes of cooking vessels, the sensor loop having different action areas which are radially spaced from each other, the action areas being substantially circumferentially directed loop portions which are interconnected by several connecting portions.

2. Radiant heater according to claim 1, wherein the sensor loop comprises only one turn.

3. Radiant heater according to claim 1, wherein the sensor loop has a shape diverging from concentricity with respect to the heating area.

4. Radiant heater according to claim 1, wherein the sensor loop being spaced from a rim of the heater, the sensor loop having in the vicinity of the heating area a magnetic field distribution with clearly defined differences in radial direction.

5. Radiant heater according to claim 1, wherein the sensor has a frequency deviation characteristic approximating a step shape, when measured for varying bottom sizes of the cooking vessel.

6. Radiant heater according to claim 1, wherein the sensor loop is self-supporting and manufactured from heat-resistant conductive material.

7. Radiant heater according to claim 1, wherein the sensor loop is supported on an insulating material rim of the heater.

8. Electric radiant heater with an active sensor for detecting the positioning of a cooking vessel on a hotplate covering the heater, the sensor being part of an inductively operating resonant circuit of a control means and being a loop of electrically conductive material positioned in the vicinity of at least one heating area heated by electric radiant heating elements and at least partly engaging over the radiant heating elements, wherein the sensor loop is made from multilayer material comprising an outer layer of heat-resistant material, filled with material having high electrical conductivity.

9. Electric radiant heater comprising at least one heating area heated by electric radiant heating elements and surrounded by an insulating rim; and an active sensor for detecting the positioning of a cooking vessel on a hotplate covering the heater, the sensor being part of an inductively operating resonant circuit of a control means responsive to frequency changes caused by presence of the cooking vessel, said sensor being a loop of electrically conductive material positioned mainly over the heating area, at least partly extending over the radiant heating elements, wherein the sensor loop is stiff to be self-supporting as to keep spacing from the radiant heating elements when being supported on said rim at bearing portions.

10. Radiant heater according to claim 9, wherein the sensor loop and the control means are provided for detecting different seizes of cooking vessels.

11. Radiant heater according to claim 9, wherein in the sensor loop has different action areas which are radially spaced from each other.

12. Radiant heater according to claim 11, wherein the action areas are substantially circumferentially directed loop portions, which are interconnected by several connecting portions.

13. Radiant heater according to claim 11, wherein different action areas of the sensor loop for detecting different cooking vessel bottom dimensions are located in different heating areas of the heater, the control means being provided for processing sensor signals of the different action areas for creating output signals causing energizing the different heating areas.

14. Radiant heater according to claim 12, wherein at least one of said loop portions is an outer part of an omega-shaped section of the loop.

15. Radiant heater according to claim 9, wherein the sensor loop is provided as a common sensor for detection of cooking vessels having different predetermined bottom dimensions, whereby different heating areas of the heater can be energized according to the bottom dimensions of the cooking vessels.

16. Radiant heater according to claim 9, wherein the sensor loop is made from thick uninsulated wire.

17. Radiant heater according to claim 9, wherein outwardly directed bends of the sensor loop form the bearing portions supported on the insulating material rim of the heater.

18. Radiant heater according to claim 9, wherein the sensor loop is made from non-magnetizable material.

19. Radiant heater according to claim 9, wherein the sensor loop is positioned just below the hotplate being significantly spaced from heating elements of the heater.

* * * * *